United States Patent [19]

Rodseth

[11] 4,016,381

[45] Apr. 5, 1977

[54] SWITCH ARRANGEMENT FOR DOOR CLOSERS

[75] Inventor: William G. Rodseth, Princeton, Ill.

[73] Assignee: Schlage Lock Company, San Francisco, Calif.

[22] Filed: July 25, 1975

[21] Appl. No.: 599,067

[52] U.S. Cl. ..... 200/61.62; 200/11 J; 200/61.7

[51] Int. Cl.² ..... H01H 3/16

[58] Field of Search ..... 200/8 R, 8 A, 61.62, 200/61.7, 11 R, 11 EA, 11 J, 153 V

[56] References Cited

UNITED STATES PATENTS

| | | | |
|---|---|---|---|
| 2,601,410 | 6/1952 | McKay | 200/61.7 X |
| 3,016,432 | 1/1962 | Bussani | 200/61.7 X |
| 3,157,756 | 11/1964 | Close et al. | 200/61.7 |
| 3,263,033 | 7/1966 | Metzger | 200/8 A |
| 3,311,717 | 3/1967 | Lace | 200/8 R |
| 3,980,843 | 9/1976 | Germain | 200/11 EA |

OTHER PUBLICATIONS

B531,425, Feb. 1976, Eley, 200, 8RX.

*Primary Examiner*—James R. Scott
*Attorney, Agent, or Firm*—Lothrop & West

[57] ABSTRACT

A door closer connected to a door panel movable on a door frame has a housing and a rod rotatable with respect to the housing in accordance with the relative position of the door panel and the door frame. The closer includes a rotary switch with limited movement which performs various switching functions dependent upon intended use with the associated electrical components and circuitry. The switch is actuated by a rod extension and also includes a hollow, insulating casing on a housing encompassing the extension with an inwardly projecting stop. An insulating rotor or clutch disc engages the extension with a slip-friction fit. The switch is constructed so it may be adjusted to match a particular door environment.

10 Claims, 14 Drawing Figures

SWITCH ARRANGEMENT FOR DOOR CLOSERS

BRIEF SUMMARY OF THE INVENTION

Under the increasing stringencies of fire and life protection, it is now important on many doors provided with door closers to make sure that the door panel is in closed position or is quickly returned thereto upon receipt of a signal such as a fire signal. This is especially important when the closer includes a hold-open mechanism controlled by a solenoid keeping the door panel held in open condition as long as the solenoid is energized. When there is a fire signal, for example, the electrical circuit of the solenoid is interrupted for a relatively long time, the hold-open is rendered ineffective and the spring in the closer moves the door panel toward its fully closed position. Occasionally, however, the hold-open solenoid current may be interrupted but momentarily. The door panel then starts towards its closed position but the hold-open device may be promptly reenergized, again becoming effective to hold the door panel nearly open. This may be an entirely unsafe condition. Also, when the hold-open device is released it is presumed that the door panel will close. But there may be some physical impediment or other reason why the door panel does not return to its fully closed position and thus may not be safe. There may be an indication that the door panel has been released to go to closed position, but there is no assurance that such position has actually been attained.

It is therefore an object of the invention to provide a way of preventing momentary interruption and subsequent reenergization of the hold-open circuit from keeping the door panel open.

Another object of the invention is to provide an arrangement in connection with a door closer to give an indication or signal when the door panel is in fact in closed position.

Another object of the invention is to provide a switch arrangement adaptable to a standard form of door closer and effective to obviate the difficulties heretofore outlined.

Another object of the invention is to provide a switch mechanism which does not materially interfere with or intrude upon the standard construction of a door closer but which is effective to provide additional functions or indications.

A further object of the invention is to provide a switch mechanism that can readily be accommodated to various styles and forms of door closers.

A still further object of the invention is to provide a switch mechanism that can easily be installed and set upon installation by relatively simple techniques.

A further object of the invention is to provide a door closer switch effective upon a hold-open device at any chosen door panel position.

A further object of the invention is in general to provide an improved door closer switch mechanism.

A further object of the invention is to augment the capabilities of door closers having hold-open features.

Other objects of the invention, together with the foregoing, are attained in the embodiment of the invention described in the accompanying description and illustrated in the accompanying drawings.

DESCRIPTION OF THE PREFERRED EMBODIMENTS

A door closer of the general type referred to is installed in connection with a door panel 6 mounted by hinges 7 to swing relative to a door frame 8 in a wall 9 of a building, the door panel 6 swinging about the vertical hinge axis through a different number of degrees; for example, 90° or 120°, more or less. When the door panel 6 is closed, it customarily rests against a stop (not shown) on the door frame 8.

Figure 1:
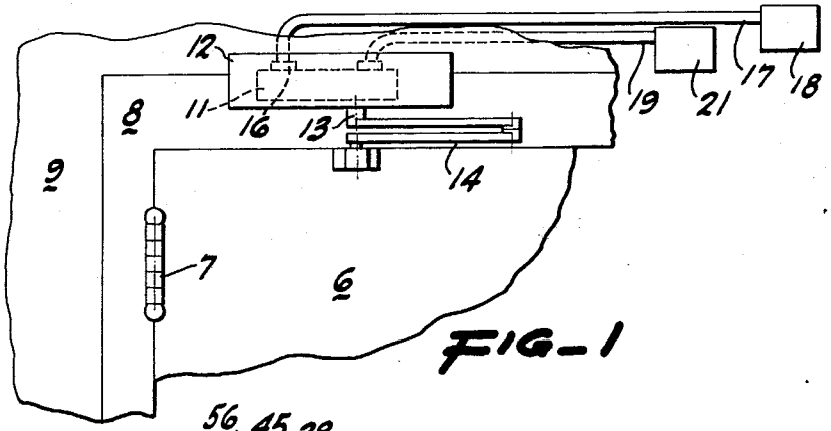
FIG. 1 is an elevation of a typical door closer installation, portions of the figure being broken away and portions being illustrated diagrammatically.
Figure 2:
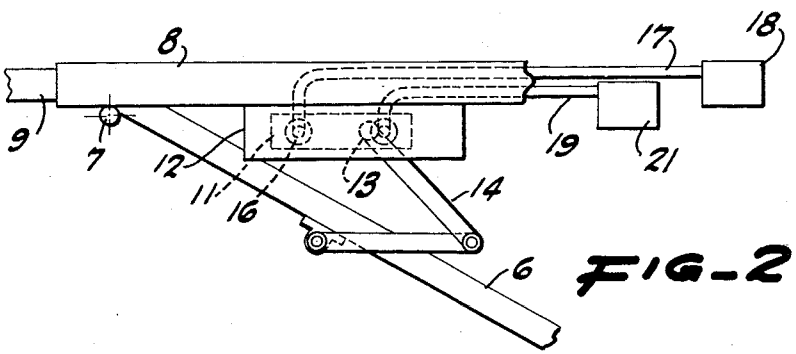
FIG. 2 is a plan of the installation shown in FIG. 1.
Figure 13:
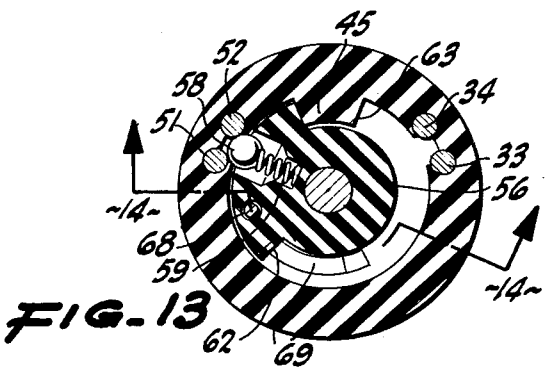
FIG. 13 is a view like FIG. 9 but showing the parts in door-closed position.
Figure 11:
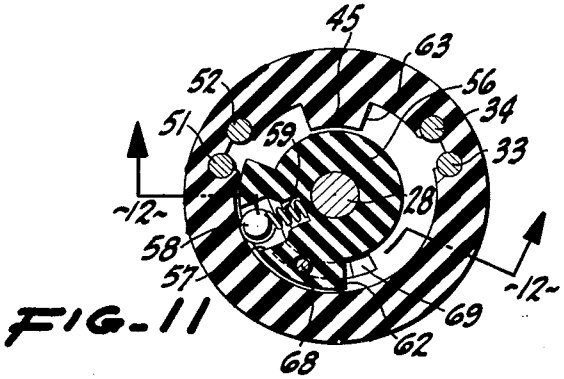
FIG. 11 is a view like FIG. 9 but showing the parts in an advanced position.
Figure 9:
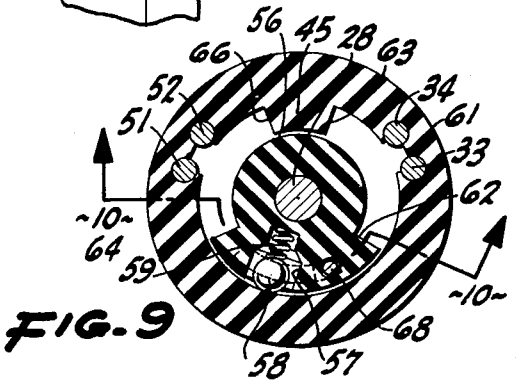
FIG. 9 is a view similar to FIG. 8 but with the parts in a different position and as seen from below looking up in a cross-section, the plane of which is indicated by the line 9—9 of FIG. 6.
Figure 14:
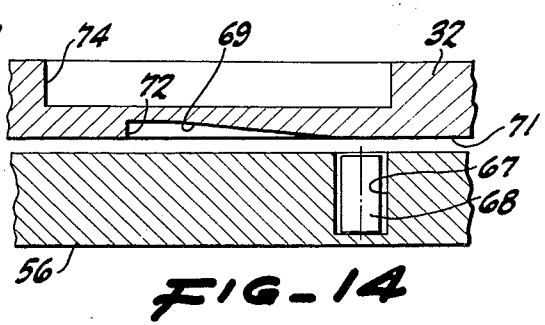
FIG. 14 is a view like FIG. 10, the planes of cross-section being shown by the lines 14—14 of FIG. 13.
Figure 12:
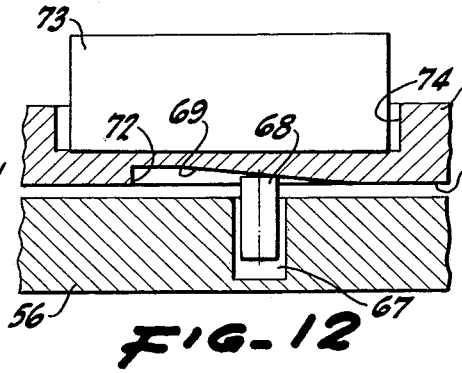
FIG. 12 is an enlarged view like FIG. 10 but with the parts in advanced position, the planes of cross-section being shown by the lines 12—12 of FIG. 11.
Figure 10:
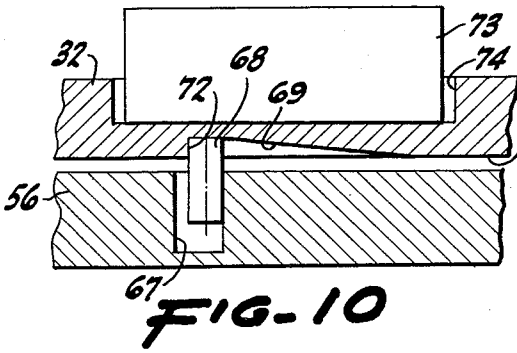
FIG. 10 is an enlarged cross-section, the planes of which are indicated by the lines 10—10 of FIG. 9.

There are many different forms of door closers and many different installation locations, but an exemplary installation includes a stationary closer housing 11 rigidly affixed to the door frame 8 and usually concealed in a decorative shell 12. The housing 11 carries an actuating rod 13 extending along a vertical axis 15 parallel to the axis of the hinge 7 and emerges not only below the housing 11, as shown in FIG. 1, but likewise emerges vertically above the housing, as shown particularly in FIGS. 3 and 6. The rod 13 has a suitable articulated connection 14 to the door panel 6 so that as the door panel swings relative to the frame 8 the rod 13 is rotated relative to the housing 11. The rod rotation is not necessarily the same as the door panel rotation and is usually a different number of degrees, depending upon the linkage.

In the customary closer, the rod in rotating relative to its housing 11 toward open position simultaneously compresses a return spring and freely displaces hydraulic fluid. During door closure the fluid is oppositely displaced under the urgency of the spring and is throttled to slow and govern the closure movement of the door panel. Optionally incorporated in the hydraulic flow passage is some sort of a blocking valve. This, when closed, prevents hydraulic flow and so prevents door panel movement. This is a so-called "hold-open" device. When the door panel is swung open to a sufficient extent and the blocking valve is then closed, the door panel cannot swing shut under force of the spring. For emergency or remote actuation purposes the blocking valve is under control of a solenoid 16 included in an electrical circuit 17 from some sort of supervisory control device 18. When the circuit 17 is energized, the solenoid 16 is effective to keep the hold-open or blocking valve closed and so maintains the door panel in open position. When, however, the circuit 17 is interrupted; for example, by operation of a primary switch at the control device 18, then the solenoid is deenergized, the blocking valve can open and the closer spring is effective to move the door panel toward its closed position. Customarily, and in some large installations, the control 18 governs the circuitry to many hold-open devices, so that if desired any group or all of the door panels in the installation can be quickly released to move toward closed position.

The rotational location of the rod 13 with respect to the housing 11 is an indication of the position of the door panel 6 with respect to the frame 8. This relationship is utilized to energize a circuit 19 and an indicator 21 of the door-closed position.

Figure 6:
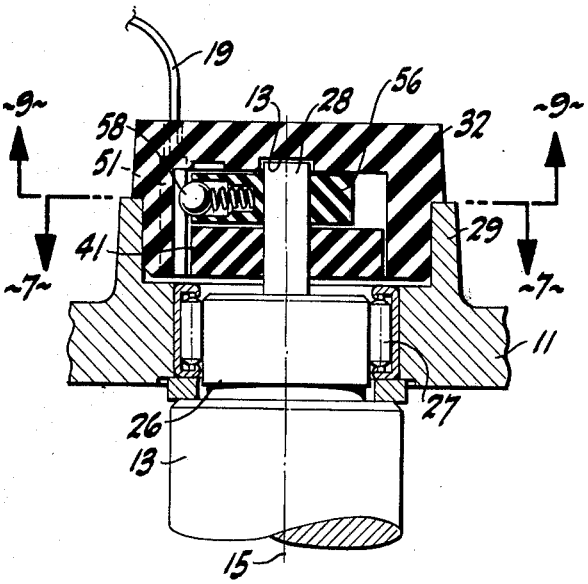
FIG. 6 is a view similar to FIG. 3 and is a cross-section, the planes of which are indicated by the lines 6—6 of FIG. 7, and particularly showing a signal switch in door-closed position.
Figure 3:
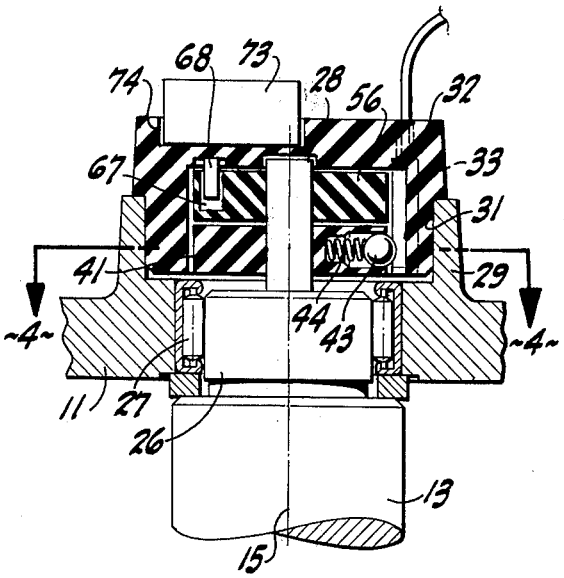
FIG. 3 is a cross-section, the planes of which are indicated by the line 3—3 of FIG. 4, and showing the secondary, hold-open switch in hold-open position.

As particularly shown in FIGS. 3 and 6, the rod 13 is supported in the housing 11 for rotation about the axis 15. A journal 26 on the rod is engaged by needle or roller bearings 27 mounted in the housing 11. Preferably formed as part of the rod 13 and projecting usually, although not necessarily, on the upper side of the housing 11 concentric with the axis 15 is a smaller diameter extension 28 of the rod 13. The upward extension is carried within a collar 29 integral with the housing and defining a socket 31. A non-rotatable housing cap 32 or switch casing fabricated of an electrical insulating material is pressed into non-rotatable position in the collar.

On the casing 32 is a first pair of electrically conductive, parallel contact bars 33 and 34. These are of circular-cylindrical configuration and are arranged with their individual axes parallel to the axis 15 but spaced apart circumferentially with the arcuate peripheral surfaces of the contact bars 33 and 34 substantially tangent to the circular-cylindrical, interior wall 36 of the housing cap 32 or casing. The wall 36 is interrupted between the bars to provide a notch 37 or recess between the contact bars. The notch affords not only a physical gap, but likewise an electrical gap, since the two contact bars 33 and 34 are included in the circuitry 17 in series with the hold-open solenoid 16 and the primary switch (not shown) therein, and such circuit is open at least between the contacts 33 and 34.

Figure 5:
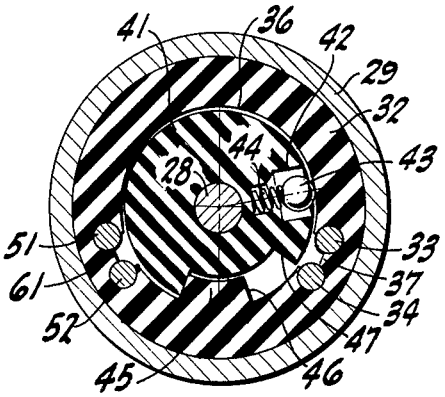
FIG. 5 is a cross-section, like FIG. 4, but showing the secondary switch out of hold-open position.

Particularly in accordance with the invention, a clutch disc 41 of plastic or other insulating material is mounted on the rod 28. The disc has a radial recess 42 within which an electrically conducting, preferably metallic, ball 43 is disposed. The ball is urged radially outward by a helical spring 44. The arrangement is such that the rod 28 when it turns is effective frictionally to rotate the disc 41 and to roll the ball 43 around the interior surface 36. When the ball is moved from a spaced position, as shown in FIG. 5, toward the nearest contact bar 33, for example, the ball continues over the contact bar smoothly until such time as the ball 43 has moved slightly past radial alignment with the rod 28 and the bar 33, or over center. The radially outward urgency of the spring 44 then tends to drive the ball 43 farther outwardly into the notch 37.

In order that such movement may be a preferred, snap action rather than a gradual action, the recess 42 is somewhat greater in diameter than the diameter of the ball 43. There is some circumferential, free movement of the ball 43 within the clutch disc 41. Thus, when the ball 43 has once well started into the notch 37, the spring 44 accelerates such movement and the ball snaps or jumps into the notch, circumferentially slightly ahead of the clutch disc 41, and so makes a quick further contact with the other bar 34. This snap action of the ball 43 thus completes locally the circuit between the contact bars 33 and 34, the ball mechanism thus constituting a secondary switch. A reverse snap action occurs when the disc moves the ball 43 out of the notch 37.

It is preferred to have this electrical contact made when the door panel is in its fully open position even though the amount of opening swing varies from installation to installation. For that reason, the housing 32 is provided with a lug 45 having a wall 46 extending into the path of a radial wall 47 of the clutch disc 41. After the door panel has achieved at least a minimum open position wherein the ball 43 is in the notch and the circuit is locally closed, the wall 47 abuts the wall 46 and arrests the rotation of the clutch disc 41. But this does not in any way impede further action by the door closer. To afford a slip action, the disc 41 has a predetermined frictional interengagement with the rod 28. The rod material and finish and the clutch disc material and finish are carefully chosen so that only a predetermined drive force is maintained under all operating conditions and over a long period.

The controlled frictional interengagement is more than adequate to move the extension 28 and the disc 41 in unison when there is no particular obstruction and when only the load of moving the ball 43 on the surface 36 and in the notch 37 is involved. But when the wall 47 comes into abutment with the wall 46 of the lug 45, then the friction drive cannot overcome that block and the walls 46 and 47 remain in abutment as the shaft extension 28 continues to turn to any desired extent within the disc 41. The door panel can be opened as far as desired without dislodging the ball 43 from the notch and abutment with the bars 33 and 34.

As soon as the door panel starts to close, for any reason, the restraint of the abutment 46 and the wall 47 is ineffective for the reverse motion and the clutch disc 41 then immediately rotates in unison with the rod extension 28 and promptly carries the ball 43 out of the notch 37 and opens the circuit at that point.

Figure 4:
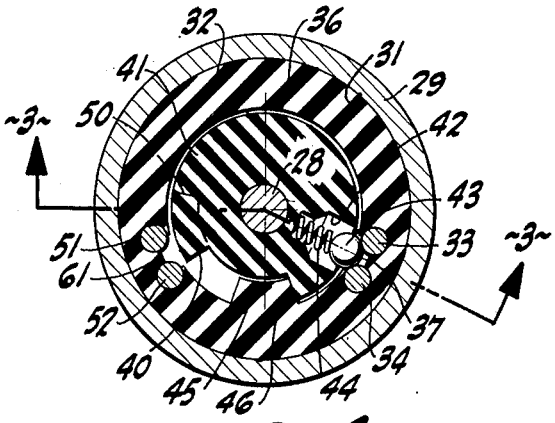
FIG. 4 is a cross-section, the plane of which is indicated by the line 4—4 of FIG. 3.

If the total angular motion of the clutch disc 41 is relatively small, as shown in FIGS. 4 and 5, then the ball 43 has a short travel and the motion of the door panel between hold-open position and released position is also relatively small. This is desirable in many instances and can even be reduced over the amount shown by building up the shoulder 40 to the right even closer to the lug 45. But it is often even more desirable to allow some additional range of opening action before the hold-open feature becomes effective. This is accomplished by appropriately providing a new shoulder 50 in any desired angular location on the clutch disc 41, as shown by broken lines in FIG. 4.

With this modified construction, the ball 43 can be displaced farther from the contact bars 33 and 34. When the door panel is opened, the displaced ball 43 then has to move farther to approach the bars 33 and 34. This extra movement prior to an electrical contact and a hold-open event affords an extended, free-swinging or "blanked out" door panel motion. The precise amount of blanked out motion allowed can be set for any installation by using a clutch disc having a correspondingly located abutting shoulder 50.

The circuitry in which the contacts 33 and 34 are included also connects the solenoid 16 in series. When the door panel is open, the position of the parts is as shown in FIG. 4. There is then a continuous circuit through the solenoid 16, but should there be a power failure or should the control 18 be actuated to deenergize the solenoid 16, or should the door panel be manually dislodged from the held-open position, the door panel immediately starts to close under the urgency of the door-closer spring. The first increment of door-closing movement is sufficient to move the ball 43 out of abutment with the contact bar 34. This immediately puts another "open" or break in the solenoid circuit. Even though power should quickly resume or the circuit should be quickly restored at the control point 18, nevertheless the secondary break at the contact bar 34 prevents reenergization of the solenoid and the door panel necessarily swings completely closed.

When the door panel is subsequently reopened from its closed position, then, as described, the ball 43 reestablishes the local portion of the circuit between the contact bars 33 and 34 and the hold-open solenoid is or can be again energized to hold the door open, provided the electrical power has been reestablished in the circuit 17.

Figure 8:
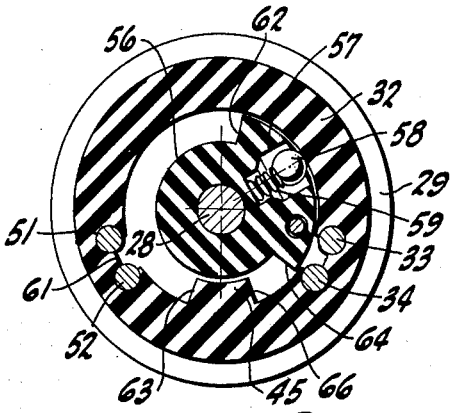
FIG. 8 is a view like FIG. 7 but showing the parts in a door-open position.
Figure 7:
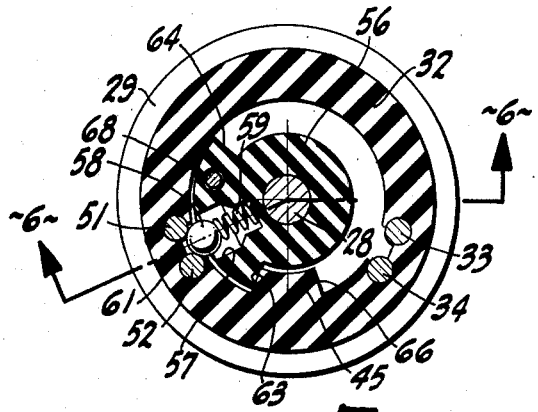
FIG. 7 is a cross-section, the plane of which is shown by the line 7—7 of FIG. 6, and in door-closed position.

In this way there has been provided an arrangement to insure that, once interrupted, the hold-open circuit cannot be reenergized until the door panel has closed and is then manually reopened. This feature can be provided alone if so desired, but in most installations it is preferred to provide a door-closed indication also. That is readily accomplished by providing an arrangement as especially illustrated in FIGS. 6, 7 and 8.

In this case the casing 32, in addition to or without the contact bars 33 and 34, has a pair of contact bars 51 and 52 arranged quite like the contact bars 33 and 34 but located in a different portion of the structure. The contact bars 51 and 52 are preferably included in series in the circuit 19 going to the indicator 21 or alarm. When the circuit 19 is closed, the indicator 21 so shows. This denotes the closed position of the door panel.

Mounted on the shaft extension 28, as before, is a second clutch disc 56 generally comparable to the first clutch disc 41 and having a similar socket 57 carrying an electrically conducting ball 58 urged radially outwardly by a spring 59. When the shaft 28 rotates, it carries the second disc 56 with it and moves the ball 58 to travel over the contact bar 51 and to jump into a notch 61 between the contact bars with a snap action. The arrangement is such that in this circuit closing position a radial wall 62 on the second disc comes into abutment with a similar wall 63 of the axially extended lug 45. When the door is swung out of its closed position toward open position, the second disc 56 rotates accordingly but always stops when a radial wall 64 on the disc comes into abutment with a wall 66 on the lug 45. The arrangement is such that while the ball 58 can come into contact with the contact bars 51 and 52, it does not travel far enough to engage between the contact bars 33 and 34. This is similar to the action of the lug 45 and the disc 41, in which case the ball 43 does not travel far enough to come into abutment with the contact bars 51 and 52. While the contact bars extend across both discs, they can be electrically bridged only by the single ball in the appropriate one of the clutch discs.

The location of the parts is preferably such that when the door panel begins to open the related circuit is immediately broken, and when the door is fully closed the related circuit is then, and only then, completed. The alarm or indicator then shows that the door panel is fully closed only when such is in fact the case.

Since the amount of door swing may vary a great deal in individual installations, provision is made for easily setting the door closing indicator disc 56 into the right orientation upon initial installation and so as to conform exactly to the requirements of that particular installation.

In order to afford special means for initially setting the closed switch mechanism, there is provided, as shown particularly in FIGS. 3 and 9 to 14, an orienting arrangement in connection with the clutch disc 56. The disc has an axial, circular recess 67 in which a magnetically responsive, preferably metallic, free pin 68 is loosely disposed. The under side of the cover of the casing 32 is contoured to afford a ramp 69 merging smoothly with the planar under surface 71 of the cover and ending at the end wall of a right-angled pocket 72. Unless otherwise constrained, the pin 68 stays in the recess 67 by gravity and is short enough to ride under the ramp 69 and the surface 71 without abutment with the under side of the housing cap 32. For initial setting, there is separately provided a generally circular magnet 73 receivable in a socket 74 in the casing cap in a location over the path of the pin 68.

Upon initial installation, the clutch disc 56 may have a random angular position on the extension 28, but it must be arranged so that in the fully closed position of the door panel the ball 58 is in abutment with the contact bars 51 and 52. Means are provided for correctly setting the clutch disc 56 after assembly and by an easy operation. The installer places the magnet 73 temporarily in the socket 74, thus imposing an upward force on the pin 68 and so drawing the top of the pin into abutment with the under surface 71 of the casing cap 32. He then opens the door. This motion rotates the clutch disc 56 accordingly with the upwardly urged pin 68 riding up the ramp 69. Part way in that motion; say, about 45°, the side of the pin abuts against the end wall of the pocket 72. Although the installer continues to open the door; say, to about 90°, the pin 68 holds the clutch disc 56 stationary relative to the casing cap 32. The extension 28 turns frictionally within the clutch disc 56 in accordance with the extent of the door opening movement.

The installer then releases his hold on the door panel, allowing it to swing toward closed position under the urgency of the closer spring. The resulting reverse rotation of the extension 28 immediately rotates the clutch disc 56 with it in the same, reverse direction. This is because the friction drive between the extension and the clutch disc is not opposed by the pin 68, for in this direction of motion the pin pulls away from the end wall 72. The conjoint return rotation continues for about 45° until the ball 58 is properly seated between the contact bars 51 and 52 and the clutch disc wall 62 abuts the wall 63 of the lug 45 as a stop when the door panel is precisely closed. The angular orientation of the closed door panel and the ball 58 engaging the bars 51 and 52 is correct for all subsequent operations. The magnet can then be removed and the pin 68 drops by gravity. The door panel is in fully closed position and the disc 56 is in position closing the "door-closed" circuit 19. Always thereafter the disc 56 occupies its just-oriented position on the rod 28 and completes the circuit 19 each time the door panel is in fully closed position.

What is claimed is:

1. In a door closer having a housing, a rod and a rod extension rotatable in said housing about an axis, and means effecting rotation of said rod and said rod extension relative to said housing in accordance with the relative position of a door panel and a door frame on which said door closer is mounted, the combination of an electrically insulated switch casing, means for securing said switch casing to said housing around said axis, an electrically insulated rotor disposed in said casing and engaging said rod extension with a predetermined friction slip fit transmitting torque therebetween only up to a predetermined maximum, at least one pair of electrical contacts in said casing exposed to said rotor and having a notch between them, and a conducting body movable on said rotor and in one position of said rotor in said casing disposed in said notch and in engagement with said pair of electrical contacts and in another position of said rotor in said casing disposed out of engagement with said pair of electrical contacts.

2. A device as in claim 1 in which said predetermined friction drive slip fit is effective to move said conducting body into and out of said notch.

3. A device as in claim 1 in which said conducting body is a ball and said ball is mounted on said rotor for limited rotation about said axis relative to said rotor.

4. A device as in claim 1 in which said friction slip fit of said rotor and said rod extension is effective to turn said rotor in unison with said rod extension despite resistance to motion of said conducting body against said contacts.

5. A device as in claim 1 including means movable into and out of a position interconnecting said casing and said rotor against relative rotation.

6. A device as in claim 5 in which said interconnecting means includes a ramp and pocket device in said casing, and a pin in said rotor movable into and out of said pocket.

7. A device as in claim 6 in which said casing is of non-magnetic material, and said pin is of magnetic material movable from a ramp-free position into a ramp-engaging position by a magnet exterior of said casing and in the vicinity of said pin.

8. A device as in claim 1 including superior means for holding said rotor against rotation relative to said casing despite relative rotation of said rod and said rotor.

9. A device as in claim 8 in which said superior means is a stop in said casing in the path of a wall on said rotor for limiting the relative rotation of said casing and said rotor in one direction.

10. A switch comprising a casing having an insulating wall concentric with an axis, a pair of electrical contacts on said wall and having facing portions extending away from said axis to define a notch, an insulating rotor, means for mounting said rotor within said casing for rotation about said axis, a driving rod extension rotatable about said axis and having a driving engagement with said rotor by a frictional fit adapted to drive below a predetermined torque and to slip above said predetermined torque, a conducting body, means for mounting said conducting body for radial motion and for rotation with said rotor, and means for resiliently urging said body radially toward said wall and between said facing contact portions into said notch with less force than required to make said driving engagement slip.

* * * * *